US009337577B1

(12) United States Patent
Hitchcock et al.

(10) Patent No.: US 9,337,577 B1
(45) Date of Patent: May 10, 2016

(54) FLOATABLE CONNECTOR

(71) Applicant: Tyco Electronics Corporation, Berwyn, PA (US)

(72) Inventors: Matthew Bryan Hitchcock, Harrisburg, PA (US); Andrew Jacob Vasbinder, Boiling Springs, PA (US); Randy Gray Simmons, Winston Salem, NC (US); Tracy Everette Wilson, Summerfield, NC (US); Hoy S. Beck, Jr., Lexington, NC (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/674,978

(22) Filed: Mar. 31, 2015

(51) Int. Cl.
*H01R 13/631* (2006.01)
*H01R 13/52* (2006.01)

(52) U.S. Cl.
CPC ..... *H01R 13/6315* (2013.01); *H01R 13/5202* (2013.01)

(58) Field of Classification Search
CPC ..... H01R 13/6315
USPC ..... 439/246–248
See application file for complete search history.

(56) References Cited

U.S. PATENT DOCUMENTS 4,915,641 A * 4/1990 Miskin ..... H01R 13/631 439/247
5,391,091 A * 2/1995 Nations ..... H01R 12/7047 439/359
5,397,244 A * 3/1995 Generoli ..... B64G 1/641 439/248
6,234,817 B1 * 5/2001 Hwang ..... H01R 13/6315 439/247
6,527,572 B2 * 3/2003 Jou ..... H01R 13/6315 439/247
6,648,676 B1 * 11/2003 Lee ..... H01R 43/24 439/499
6,679,712 B2 * 1/2004 Chang ..... H01L 23/4093 257/E23.086
6,679,726 B1 * 1/2004 Tunn ..... H01R 13/6315 439/550
6,736,659 B1 * 5/2004 Wu ..... H01R 13/6315 439/247
6,758,690 B1 * 7/2004 Yu ..... H01R 13/6485 439/140
6,773,286 B1 * 8/2004 Wu ..... H01R 13/629 439/247
6,824,419 B1 * 11/2004 Wu ..... H01R 13/6315 439/366
6,890,200 B1 * 5/2005 Wu ..... H01R 13/6315 439/247

(Continued)

*Primary Examiner* — Ross Gushi

(57) ABSTRACT

A floatable connector is provided that includes a housing and a bushing. The housing includes at least one mounting ear. The mounting ear has an aperture therethrough and at least one deflectable finger that extends into the aperture from an inner surface defining the aperture. The bushing is loaded into the aperture. The bushing includes a stem between a first flange and a second flange. The bushing defines a channel therethrough. The diameter of the aperture of the mounting ear is greater than the diameter of an outer surface of the stem such that an axially extending gap is formed between the inner surface of the mounting ear and the outer surface of the stem. The housing is floatable radially within the gap relative to the bushing.

20 Claims, 3 Drawing Sheets

(56) References Cited

U.S. PATENT DOCUMENTS 6,896,556 B1 * 5/2005 Wu ..... H01R 31/06 439/638
7,059,882 B2 * 6/2006 Sugita ..... H01R 13/6315 439/247
7,074,084 B2 * 7/2006 Shuey ..... H01R 13/6315 439/247
7,090,521 B2 * 8/2006 Nishio ..... H01R 13/6315 439/248
7,201,594 B2 * 4/2007 van der Mee ..... H01R 13/6315 439/247
7,559,796 B1 * 7/2009 Wu ..... H01R 13/748 439/564
7,607,930 B1 * 10/2009 Wu ..... H01R 13/745 439/247
7,950,942 B2 * 5/2011 Klinger ..... H01R 13/6315 439/247
8,231,399 B2 * 7/2012 Daubigney ..... H01R 13/6275 439/247
8,337,242 B2 * 12/2012 Sun ..... H01R 13/74 439/499
8,535,091 B2 * 9/2013 Fu ..... H01R 13/745 439/545
8,696,380 B2 * 4/2014 Su ..... H01R 13/504 439/345
8,734,172 B2 * 5/2014 Takei ..... H01R 12/7005 439/248
8,894,431 B2 * 11/2014 Tiberghien ..... F16L 37/56 439/247
8,936,484 B2 * 1/2015 Metzler ..... H01R 13/5221 439/569
8,951,055 B2 * 2/2015 Eusterholz ..... H01R 13/6315 439/248
9,116,170 B2 * 8/2015 Guo ..... G01R 1/04
9,190,768 B2 * 11/2015 Ikeya ..... H01R 13/5202
9,231,352 B2 * 1/2016 Sasaki ..... H01R 13/6315
2001/0051452 A1 * 12/2001 Walker ..... F16L 5/00 439/248
2006/0057862 A1 * 3/2006 Oberstarr ..... H01R 13/6315 439/1
2006/0141836 A1 * 6/2006 Van Der Mee ..... H01R 13/6315 439/247
2008/0293277 A1 * 11/2008 Kumar ..... H01R 13/53 439/247
2009/0068870 A1 * 3/2009 Mezhinsky ..... G02B 6/3882 439/247
2013/0088822 A1 * 4/2013 Roesner ..... G06F 1/181 361/679.4
2013/0252458 A1 * 9/2013 Krome ..... B60L 11/1818 439/378
2014/0302711 A1 * 10/2014 Suzuki ..... H01R 13/5202 439/556
2015/0229055 A1 * 8/2015 Fukushima ..... H01R 13/08 439/733.1
2015/0333446 A1 * 11/2015 Yuan ..... H01R 13/665 439/248

* cited by examiner

FLOATABLE CONNECTOR

BACKGROUND OF THE INVENTION

The subject matter herein relates generally to floatable electrical connectors.

Some known electrical connectors are pass-through connectors that may be used to provide an electrical conductive path through a panel. For example, the panel may be a cover for an electrical device, and the connector extends through a defined opening in the panel to electrically connect electrical components of the device internal to the cover to an external mating connector. The pass-through connector passes through the opening in the panel such that a first portion of the connector is on a first side of the panel and a second portion of the connector is on an opposite second side of the panel. The first portion of the connector may be configured to interface with the mating connector. The second portion of the connector on the other side of the panel may be electrically connected to electrical components of the electrical device. A peripheral seal may be located at the interface between the panel and the connector in order to seal the connector to the panel at the opening. The seal may prevent air, liquid, and/or debris from leaking through the opening of the panel around the connector. In an example application in the automotive industry, the pass-through connector may be installed through a transmission cover to provide electrical power, control, and/or data signals to and/or from the transmission.

Some known electrical connectors are header connectors that are configured to be mounted to a case or housing, such as a housing of an electrical and/or mechanical device. Some known header connectors are pass-through connectors that are mounted to a housing of an electrical device and also extend at least partially through a panel that is placed over the connector. Optionally, the panel may be mounted to the housing of the electrical device separately from the connector, and the connector may not be directly coupled to the panel.

As a result, the opening of the panel may not align correctly with the portion of the connector configured to extend through the panel. For example, the gap between the panel and the connector may be non-uniform, having a larger gap on one side than another. Although a compression seal may be installed at the interface of the connector and the panel, the seal would be compressed more at the side with the smaller gap than at the side with the larger gap. Due to the different gap sizes and resulting different compressive forces on the seal, the seal may fail, allowing a leak at either of the sides having non-uniform gaps. Referring back to the example application of the connector installed on a transmission housing, if the transmission cover is not properly aligned with the connector, a leak path may form that allows the unintentional transfer of pressure, gases, liquids, and contaminants into and out of the transmission cover, which could harm the performance of the transmission. A need remains for an electrical connector that is capable of floating within a predefined area to properly align with a mating connector, an opening in a panel, and/or the like.

BRIEF DESCRIPTION OF THE INVENTION

In an embodiment, a floatable connector includes a housing and a bushing. The housing has at least one mounting ear. The mounting ear has an aperture therethrough and at least one deflectable finger that extends at least partially into the aperture from an inner surface defining the aperture. The bushing is loaded into the aperture. The bushing includes a stem extending along a bushing axis between a first flange and a second flange. The bushing defines a channel therethrough along the bushing axis. The diameter of the aperture of the mounting ear is greater than the diameter of an outer surface of the stem such that an axially extending gap is formed between the inner surface of the mounting ear and the outer surface of the stem. The housing is floatable radially within the gap relative to the bushing.

In an embodiment, a floatable connector includes a housing, a compression seal, and a bushing. The housing has a mating end and a mounting end. The mating end extends through a window of a panel. The housing has at least one mounting ear proximate to the mounting end. The mounting ear includes an aperture therethrough and at least one deflectable finger extending at least partially into the aperture from an inner surface defining the aperture. The compression seal is disposed around a perimeter of the housing. The compression seal is received between the housing and the window to seal the housing to the panel. The bushing is loaded into the aperture. The bushing includes a stem extending along a bushing axis between a first flange and a second flange. The bushing defines a channel therethrough along the bushing axis. The bushing is configured to receive a fastener through the channel. The fastener is fixed relative to the panel. The diameter of the aperture of the mounting ear is greater than the diameter of an outer surface of the stem such that an axially extending gap is formed between the inner surface of the mounting ear and the outer surface of the stem. The housing is floatable radially within the gap relative to the fastener and the panel to align with the window.

DETAILED DESCRIPTION OF THE INVENTION

One or more embodiments of the subject matter described herein provide a floatable connector with features that allow the connector to float in order to properly align with a mating connector, a window of a panel, or the like.

Figure 1:
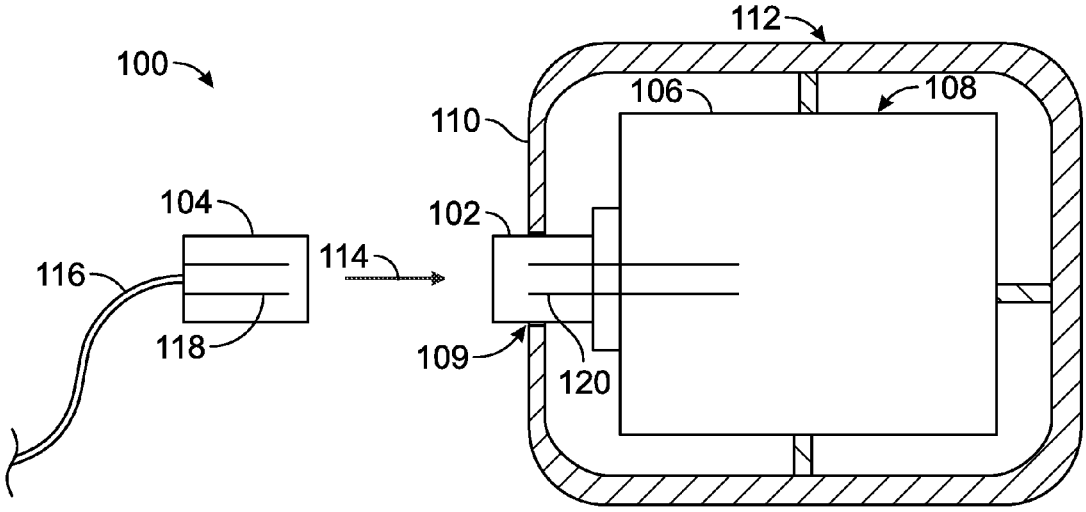
FIG. 1 is a schematic block diagram of an electrical connector system formed in accordance with an exemplary embodiment.

FIG. 1 is a schematic block diagram of an electrical connector system 100 formed in accordance with an exemplary embodiment. The electrical connector system 100 has a floatable electrical connector 102 configured to couple with a mating electrical connector 104. In one or more embodiments, the electrical connector 102 may be a header connector that is mounted to a header 106. The header 106 may be a structural component of a device 108. For example, the header 106 may be a chassis, a block, a frame, a case, and/or the like. The device 108 may be or include a motor, an engine, a transmission, a computer, a sensor, and/or the like. In an embodiment, the device 108 may be an automotive device. For example, the device 108 may be a transmission, and the header 106 may be a transmission case.

In one or more embodiments, the connector 102 may be a pass-through connector that extends through a window 109 in a panel 110. The panel 110 optionally may be part of a cover 112 that surrounds at least a part of the header 106 of the device 108. The cover 112 may protect the device 108 from debris, liquids, and other contaminants external to the cover 112. The cover 112 also may be used as a barrier to maintain internal conditions (e.g., temperature, pressure, gases) within the cover 112 that may differ from ambient external conditions. The cover 112 may be separately mounted or coupled to the header 106 from the connector 102, with the connector 102 aligned with and/or extending through the window 109.

Although the electrical connector 102 in the illustrated embodiment may be a pass-through header connector, it is understood that FIG. 1 is merely an example application for the electrical connector 102, and the electrical connector 102 is not limited to being a pass-through header connector. In other applications, the electrical connector 102 may be a header connector that does not pass through a panel, may be a pass-through connector that does not mount to a header, or may be neither a header connector nor a pass-through connector. The electrical connector 102 may be referred to herein as floatable connector 102 or simply as connector 102.

As shown in FIG. 1, the mating connector 104 is poised for mating with the connector 102 along mating axis 114. The mating connector 104 may be a plug connector terminated to a cable 116, as shown. Alternatively, the mating connector 104 may be header connector that is mounted to a substrate, such as a printed circuit board, or another electrical device. The mating connector 104 includes multiple mating conductors 118, and the connector 102 includes multiple header conductors 120. When the mating connector 104 mates to the connector 102, the mating conductors 118 engage corresponding header conductors 120 to electrically connect the mating connector 104 to the connector 102. When mated, the connectors 102, 104 form electrically conductive pathways that convey electrical signals (e.g., power, control, data, etc.) between an electrical component on or within the device 108 and an electrical component (not shown) coupled to a distal end of the cable 116.

It should be noted that FIG. 1 is schematic in nature and intended by way of example. In various embodiments, various aspects or structures may be omitted, modified, or added. Further, various devices, systems, or other aspects may be combined. For example, the cover 112 optionally may not surround an entire periphery of the device 108 as is shown.

Figure 2:
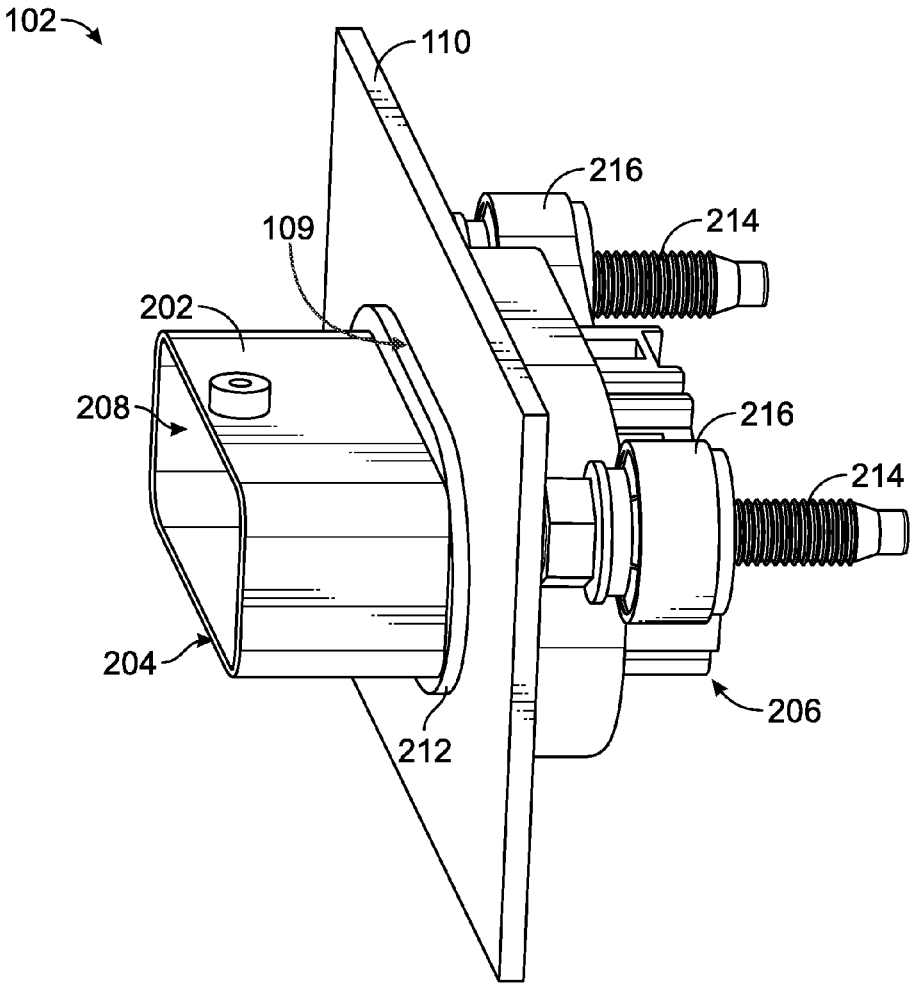
FIG. 2 is a perspective view of an embodiment of a header connector of the electrical connector system of FIG. 1.

FIG. 2 is a perspective view of an embodiment of the floatable connector 102 of the electrical connector system 100 of FIG. 1. The connector 102 includes a header housing 202. The housing 202 includes a mating end 204 and a mounting end 206. The mating end 204 is configured to interface with a mating connector, such as the mating connector 104 (shown in FIG. 1). For example, the mating end 204 defines a receptacle 208 that receives mating conductors 118 (shown in FIG. 1) that electrically engage the corresponding header conductors 120 (shown in FIG. 1).

The mating end 204 of the housing 202 extends through a window 109 of a panel 110. The window 109 may be configured to have an area slightly larger than a cross-sectional area of the mating end 204 of the housing 202 to allow the mating end 204 to extend through the window 109. In an exemplary embodiment, the connector 102 includes a compression seal 304 (shown in FIG. 3) that is disposed around a periphery of the housing 202 between the mating end 204 and the mounting end 206. The compression seal 304 is configured to be received between the housing 202 and the window 109 to seal the housing 202 to the panel 110. For example, the compression seal 304 may fill gaps between the housing 202 and the panel 110 that are present due to the window 109 being slightly larger than a cross-section of the housing 202. Optionally, the housing 202 may include a raised shoulder 212 that receives the compression seal 304 thereon.

The mounting end 206 of the housing 202 is configured to abut a mount surface (not shown) of a device or structure on which the connector 102 is mounted, such as the header 106 (shown in FIG. 1). One or more fasteners 214 may be used to mount the connector 102 to the mount surface. The fastener(s) 214 are loaded through the housing 202. For example, the housing 202 may include at least one mounting ear 216 that is proximate to the mounting end 206. The mounting ear(s) 216 receive a corresponding fastener 214 therethrough for coupling to the mount surface of the device or structure. In the illustrated embodiment, the housing 202 includes two mounting ears 216 and two corresponding fasteners 214. The fasteners 214 may couple to the mount surface such that the fasteners 214 are fixed relative to the device or structure. In addition, although not shown in FIG. 2, the panel 110 may optionally also be coupled to the mount surface such that the panel 110 is also fixed relative to the device or structure.

Figure 3:
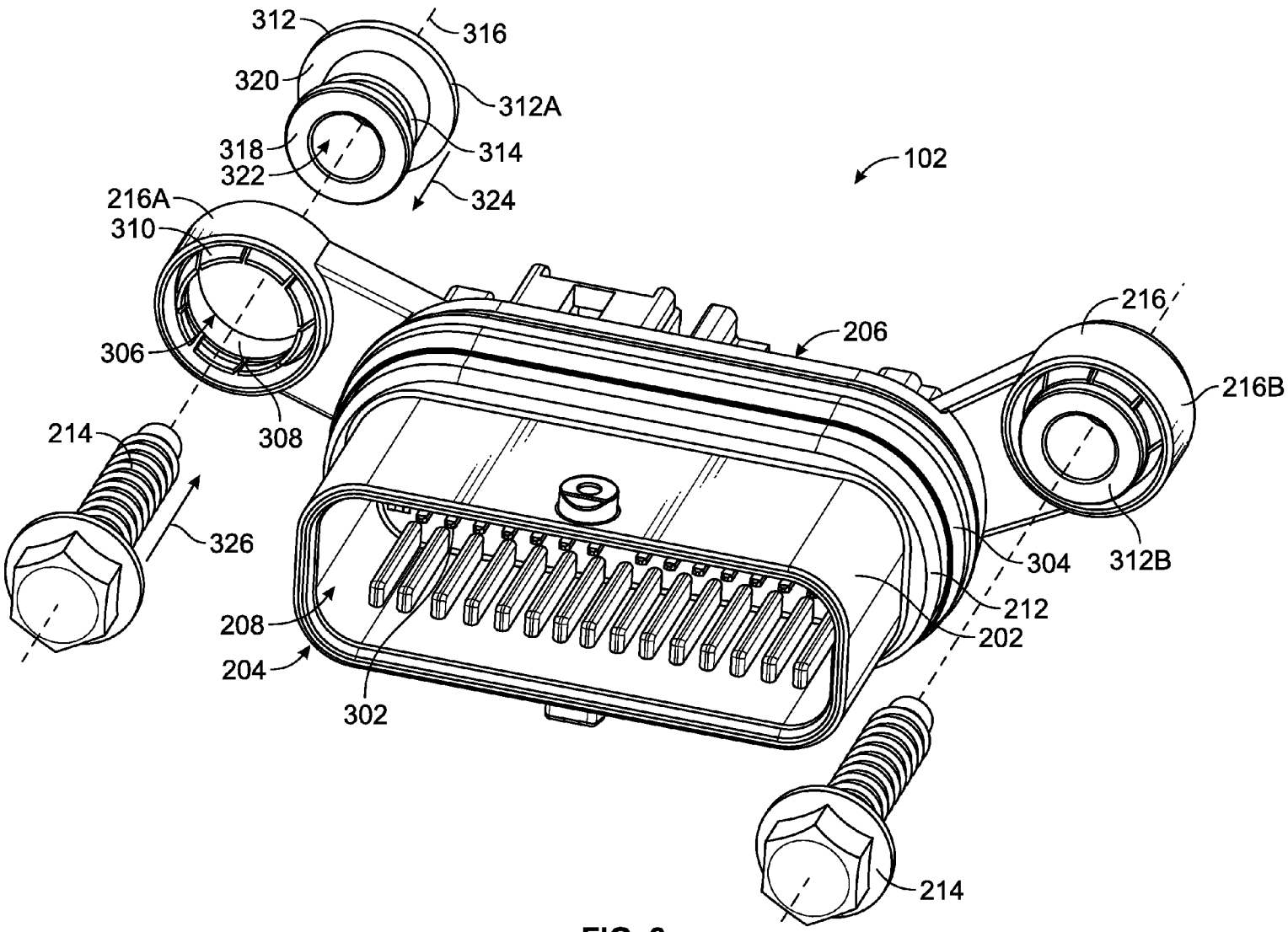
FIG. 3 is a partially-exploded perspective view of an embodiment of a header connector of the electrical connector system of FIG. 1.

FIG. 3 is a partially-exploded perspective view of an embodiment of the connector 102 of the electrical connector system 100 of FIG. 1. The housing 202 may be formed of an electrically insulating material, such as a plastic, a rubber-like polymer, and/or the like. Optionally, the housing 202 may be molded into a single integral component. The housing 202 includes a plurality of contacts 302 within the receptacle 208 extending towards the mating end 204. The contacts 302 may be ends of the conductors 120 (shown in FIG. 1) and are configured to engage and electrically connect to mating contacts (not shown) of the mating conductors 118 (shown in FIG. 1). The contacts 302 may be formed of a conductive material, such as copper or another metal. The contacts 302 may be terminated to wires of a wire harness or directly to a circuit board within an electronic device, such as the device 108 (shown in FIG. 1).

The compression seal 304 may be formed of a compressive material, such as rubber, a rubber-like polymer, or the like, such that the seal 304 is able to be compressed between the housing 202 and the panel 110 (shown in FIG. 2). In an exemplary embodiment, the seal 304 is a band than extends continuously around a perimeter of the housing 202. The seal 304 may be a gasket. The seal 304 may be loaded onto the housing 202 by sliding and/or stretching the seal 304 around the mating end 204 in a direction towards the mounting end 206. For example, the seal 304 may be advanced to the shoulder 212 of the housing 202, which is between the mating end 204 and the one or more mounting ears 216 that are proximate to the mounting end 206.

In an embodiment, each mounting ear 216 has an aperture 306 that extends through the ear 216. The aperture 306 is defined by an inner surface 308 of the ear 216. The mounting ear 216 includes at least one deflectable finger 310 that extends at least partially into the aperture 306 from the inner surface 308. For example, the deflectable finger(s) 310 may extend into the aperture 306 such that the deflectable finger(s) 310 decrease the diameter of the aperture 306 relative to the diameter of the aperture 306 as defined by the inner surface 308. Each deflectable finger 310 is biased to extend into the aperture 306. As such, the finger(s) 310 may be deflected radially outward by a contacting force, but once the contacting force is removed, the finger(s) 310 deflect back to extend into the aperture 306. In an exemplary embodiment, the ear 216 includes a plurality of deflectable fingers 310 that are evenly dispersed around a perimeter of the inner surface 308. Optionally, spaces may be defined between adjacent fingers 310. Each finger 310 may be independently deflectable. In an alternative embodiment, the mounting ear 216 may have only a single deflectable finger 310 that extends around the perimeter of the inner surface 308.

The electrical connector 102 includes at least one bushing 312 that is configured to be loaded into the aperture 306 of the mounting ear 216. In an exemplary embodiment, the bushing 312 includes a stem 314 that extends along a bushing axis 316 between a first flange 318 and a second flange 320. For example, the stem 314 bridges the distance between and connects the flanges 318, 320. The bushing 312 also defines a channel 322 through the length of the bushing 312 along the bushing axis 316. The bushing 312 may be formed of a metal or plastic material. In an exemplary embodiment, the bushing 312 may act as a compression limiter that absorbs compressive forces generated by tightening the fastener 214, thereby reducing the compressive forces applied to the mounting ear 216.

During assembly of the electrical connector 102, the bushing 312 may be loaded into the aperture 306 of the mounting ear 216. For example, the bushing 312 may be loaded from the mounting end 206 towards the mating end 204 of the housing 202 in the loading direction 324. In an exemplary embodiment, as the bushing 312 is loaded, the first flange 318 contacts the deflectable finger(s) 310 and deflects the finger(s) 310 radially outward. When the first flange 318 moves beyond (e.g., past) the finger(s) 310 in the loading direction 324, the contacting force is removed and the finger(s) 310 deflect radially inward behind the first flange 318. In the illustrated embodiment, the electrical connector 102 has two mounting ears 216A, 216B and two corresponding bushings 312A, 312B. Bushing 312A is shown poised for loading into the aperture 306 of the respective mounting ear 216A, while bushing 312B is shown fully loaded within the respective mounting ear 216B.

The channel 322 of the bushing 312 is configured to receive the fastener 214 therethrough. For example, during assembly the fastener 214 may be installed through the channel 322 in an installation direction 326 that extends from the mating end 204 side of the mounting ear 216 towards the mounting end 206. In an exemplary embodiment, the bushing 312 is loaded into the aperture 306 of the mounting ear 216 prior to the fastener 214 being installed through the channel 322 of the bushing 312. The fastener 214 may be a bolt. In an embodiment, the fastener 214 is a threaded bolt or a screw. Alternatively, the fastener 214 may be another type of fastener, such as a pin bolt, a rivet, a latch, and/or the like. In an exemplary embodiment, the housing 202 includes a plurality of mounting ears 216, and each mounting ear 216 is configured to receive a corresponding bushing 312 and fastener 214.

Figure 4:
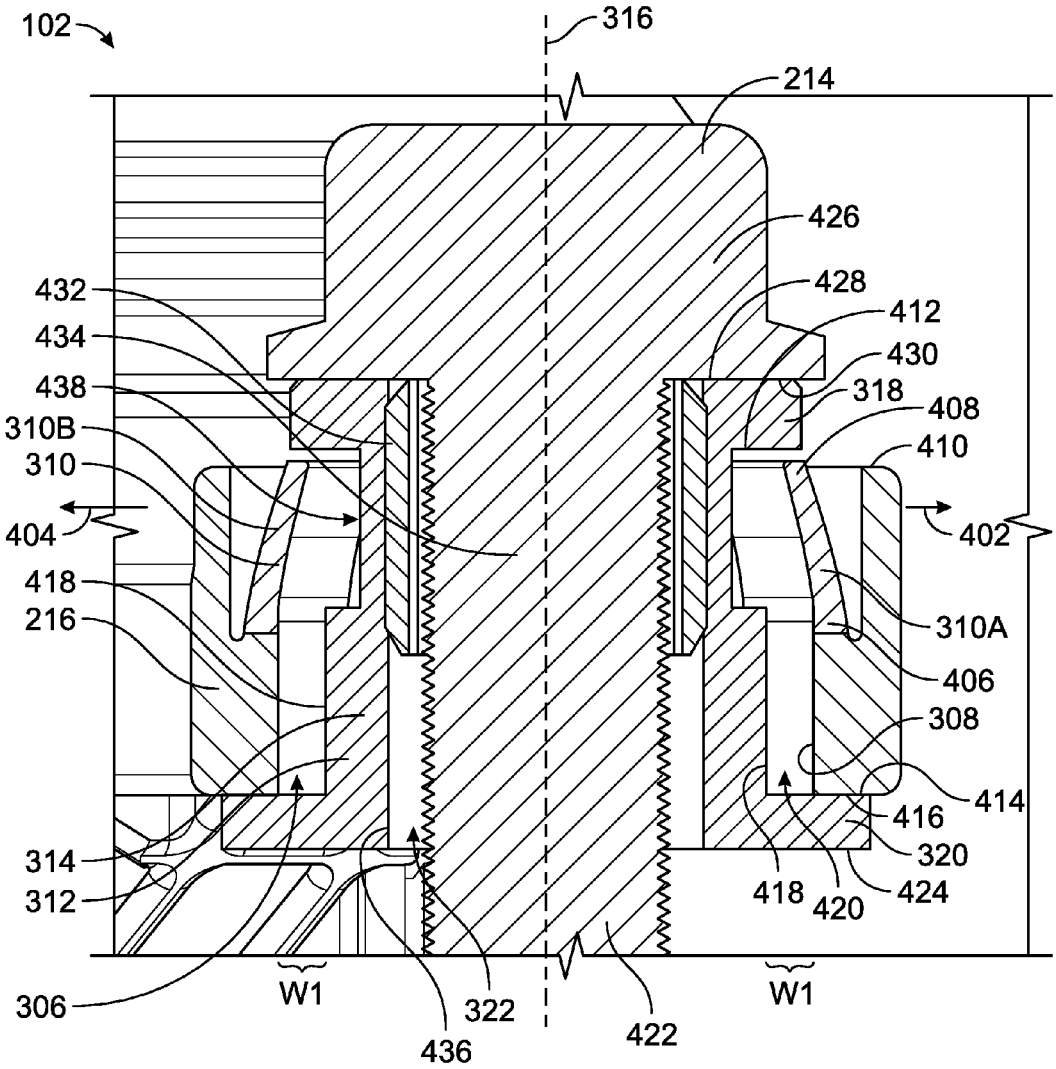
FIG. 4 is a cross-section of an embodiment of a header connector of the electrical connector system of FIG. 1.

FIG. 4 is a cross-section of an embodiment of the connector 102 of the electrical connector system 100 of FIG. 1. The one or more deflectable fingers 310 each may have a base 406 that protrudes from the inner surface 308. The deflectable fingers 310 each may have a distal end 408 at an opposite end from the base 406 and extend at least partly into the aperture 306 such that the distal end 408 is more proximate to the center (e.g., axis) of the aperture 306 than the base 406. In addition to extending towards the center of the aperture 306, the deflectable fingers 310 also may extend at least partially in a direction parallel to the loading direction 324 (shown in FIG. 3) of the bushing 312. As shown in FIG. 4, the deflectable fingers 310 may extend inward and upward such that when the bushing 312 is being loaded in the upward loading direction 324, the first flange 318 deflects the one or more deflectable fingers 310 radially outward until the first flange 318 moves beyond the deflectable fingers 310. For example, a first deflectable finger 310A deflects outward along direction 402, and a second deflectable finger 310B on the opposite side of the cross-section deflects outward along the opposite direction 404. As shown in FIG. 4, the bushing 312 is fully loaded within the mounting ear 216, such that the deflectable fingers 310 are between the first and second flanges 318, 320. In an alternative embodiment, the deflectable fingers 310A, 310B may be two sides of a single deflectable finger that extends at least most of the way around the periphery of the inner surface 308 instead of two separate deflectable fingers.

Once the bushing 312 is fully loaded within the mounting ear 216, the bushing 312 is retained within the aperture 306 by the flanges 318, 320. For example, the bushing 312 is retained within the mounting ear 216 at a first (e.g., bottom) end 414 of the of the mounting ear 216 by an inner surface 416 of the second flange 320 which engages the bottom end 414 of the mounting ear 216. In an embodiment, the diameter of the first flange 318 of the bushing 312 is smaller than the diameter of the aperture 306, while the diameter of the second flange 320 is larger than the diameter of the aperture 306. Thus, as the bushing 312 is loaded in the loading direction 324 (shown in FIG. 3), the first flange 318 extends through the aperture 306 while the second flange 320 contacts the bottom end 414 of the mounting ear 216, prohibiting further movement of the bushing 312 in the loading direction 324. Furthermore, at a second (e.g., top) end 410 of the mounting ear 216, an inner surface 412 of the first flange 318 engages the distal end 408 of the deflectable fingers 310 to retain the bushing 312 within the aperture 306 of the mounting ear 216. For example, when the bushing 312 is fully loaded within the mounting ear 216, the deflectable fingers 310 contact the inner surface 412 of the first flange 318 to prohibit excess movement of the bushing 312 in a direction opposite to the loading direction 324. The inner surfaces 412, 416 may be adjacent to the stem 314 and may face each other. Optionally, the inner surfaces 412, 416 may be generally orthogonal to the bushing axis 316.

The fastener 214 extends through the channel 322 of the bushing 312. The fastener 214 is configured to be coupled to a mount surface of a device or structure, such as the header 106 (shown in FIG. 1). For example, a tip or distal end 422 of the fastener 214 may extend beyond the bottom end 414 of the mounting ear 216 and beyond the second flange 320 of the bushing 312 to couple to the mount surface. The mount surface of the device or structure optionally may interface with an outer surface 424 of the second flange 320. The fastener 214 may have a head 426 that is opposite to the distal end 422. The head 426 may be used for coupling and/or uncoupling the fastener 214, and a distal-facing (e.g., lower) surface 428 of the head 426 may engage an outer surface 430 of the first flange 318 of the bushing 312. As a result, the bushing 312 may be sandwiched between the mount surface of the device and the lower surface 428 of the head 426, such that the bushing 312 is allowed little to no axial movement relative to the fastener 214.

Optionally, a sleeve 432 may be disposed around a shaft 434 of the fastener 214. The sleeve 432 may be formed of a compressive material, such as rubber or a rubber-like polymer (e.g., plastic) or polymer blend, and are retained on the fastener 214 by a friction/interference fit. The sleeve 432 is configured to engage an inner surface 436 of the bushing 312 that defines the channel 322. In an embodiment, the sleeve 432 compresses to fill any clearances between the inner surface 436 of the bushing 312 and the shaft 434 of the fastener 214. As a result, the bushing 312 may be generally fixed to the fastener 214 by an interference fit such that the bushing 312 is allowed only negligible radial and/or rotational movement relative to the fastener 214. Optionally, the bushing 312 may be generally fixed to the fastener 214 without the use of the sleeve 432, such as by an interference fit due to tight clearance between the fastener 214 and the inner surface 436 of the bushing 312. The fastener 214, as mentioned, is configured to be coupled to and fixed relative to the device or structure, such as the header 106 (shown in FIG. 1). Furthermore, since the bushing 312 may be generally fixed (e.g., axially, radially, and/or rotationally) to the fastener 214, the bushing 312 may also be fixed relative to the device or structure.

In an exemplary embodiment, the diameter of the aperture 306 of the mounting ear 216 is greater than the diameter of an outer surface 418 of the stem 314. As a result, an axially extending gap 420 is formed or defined between the inner surface 308 of the mounting ear 216 and the outer surface 418 of the stem 314. The gap 420 has a length that extends in the axial direction generally parallel to the bushing axis 316. The gap 420 has a width that extends in the radial direction orthogonal to the bushing axis 316. For example, the width W1 of the gap 420 may be the radial distance between the outer surface 418 of the stem 314 and the inner surface 308 of the mounting ear 216 when the bushing 312 and the mounting ear 216 share a common axis (e.g., are concentric). In FIG. 4, the width W1 of the gap 420 is approximately equal on both sides of the bushing 312, as the bushing 312 and mounting ear 216 are approximately concentric along the bushing axis 316.

The mounting ear 216 of the housing 202 (shown in FIG. 3) is able to float radially within the gap 420 relative to the bushing 312. Since the bushing 312 may be fixed to the fastener 214, the housing 202 may also float radially relative to the fastener 214 that is coupled to a device or structure, such as the header 106 (shown in FIG. 1). When the bushing 312 and the mounting ear 216 are aligned along the same axis, the housing 202 is permitted to float radially relative to the fastener 214 in any radial direction for a distance that is no more than the width W1. The maximum width of the gap 420 on a single side is no more than twice the width W1. The electrical connector 102 is configured such that the mounting ear 216 is retained between the flanges 318, 320 of the bushing 312 regardless of the radial location of the mounting ear 216 relative to the bushing 312. For example, even when the outer surface 418 of the stem 314 contacts the inner surface 308 of the mounting ear 216 on one side such that the gap 420 is maximized on the opposite side, the mounting ear 216 is prohibited from moving axially beyond the first and/or second flanges 318, 320 of the bushing 312.

In an exemplary embodiment, the stem 314 of the bushing 312 defines a groove 438 that extends along a perimeter of the outer surface 418. The groove 438 may be aligned with the one or more deflectable fingers 310 of the mounting ear 216. For example, the groove 438 may be along a portion of the stem 314 that is proximate to at least the distal end 408 of the deflectable fingers 310. Since the deflectable fingers 310 extend at least partially inward towards the center or axis of the aperture 306, the groove 438 reduces the diameter of the stem 314 that is proximate to the fingers 310 to retain the gap 420 between the mounting ear 216 and the stem 314 of the bushing 312. As shown in FIG. 4, the groove 438 may extend from the first flange 318 for at least a portion of the length of the stem 314 towards the second flange 320. Because of the groove 438, the gap 420 between the inner surface 308 of the mounting ear 216 and the outer surface 418 of the stem 314 is maintained along the length of the stem 314 between the first and second flanges 318, 320. It is noted that the groove 438 along the outer surface 418 of the stem 314 is optional, and in other embodiments the diameter of the outer surface 418 may be uniform along the length of the stem 314 between the two flanges 318, 320.

Referring now to FIG. 4 with additional reference to FIGS. 1 and 2, the fastener(s) 214 may be used to mount the connector 102 to a device or structure, such as the header 106. Once coupled, the fastener 214 is fixed relative to the header 106. Therefore, the housing 202 is able to float along the gap 420 relative to the fastener 214 and, transitively, relative to the header 106. In an exemplary embodiment, after the connector 102 is mounted to the header 106, the panel 110 may be placed over the mating end 204 of the housing 202 such that the mating end 204 is received through the window 109 of the panel 110. Alternatively, the panel 110 may be stationary, and the header 106 with the mounted connector 102 is moved relative to the panel 110 to insert the connector 102 through the window 109. The window 109 has a narrow clearance around the perimeter of the housing 202, which allows the compression seal 304 (shown in FIG. 3) to effectively seal the housing 202 to the panel 110.

The panel 110 may be mounted relative to the header 106 or another mounting surface, such that the window 109 of the panel 110 may be fixed in one place. The fastener 214 of the connector 102 is also fixed in one place within the header 106. However, the connector 102 is not fixed directly to the panel 110. In some known connector systems, if one or more measurements or positions of the header, the panel, or the connector are off by even a slight margin, the connector may not align correctly with a window of the panel. Even if the connector fits within the window, the misalignment causes uneven sealing between the edges of the window and the connector. The uneven sealing can result in undesirable leaks that allow the transfer of temperature, pressure, contaminants, gases, liquids, debris, and/or the like through the window between the connector and the panel.

In an exemplary embodiment, the housing 202 of the connector 102 is able to float relative to the panel 110 to align the housing 202 with the window 109. For example, although both the fastener 214 and the panel 110 may be fixed in place, the mounting ear 216 is able to float radially within the gap 420 relative to both the fastener 214 and the panel 110. As the mating end 204 of the housing 202 is loaded through the window 109, the compression seal 304 (shown in FIG. 3) and/or shoulder 212 engages an interior wall (not shown) of the panel 110 that defines the window 109. If the window 109 is not properly aligned with the connector 102, the force from the interior wall on the seal 304 and/or shoulder 212 causes the housing 202 to float in a direction to reduce unbalanced forces. For example, if the housing 202 is too close on a first edge or side of the window 109, the interior wall at the first edge will apply more force on the seal 304 and/or shoulder 212 than is applied by the interior wall at the opposite edge or side of the window 109, where the clearance is greater. As a result, the housing 202 may float towards the opposite edge until the forces on the seal 304 from both edges are approximately equal and the housing 202 is centered in the window 109. Therefore, since the mounting ears 216 float relative to the respective bushings 312 and fasteners 214, the housing 202 is able to self-center itself within the window 109 of the panel 110. When the housing 202 is centered, the compressive forces on the compression seal 304 may be generally equal around the perimeter of the shoulder 212, which reduces the likelihood of leaks through the window 109 between the panel 110 and the connector 102.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A floatable connector comprising:

a housing having at least one mounting ear, the mounting ear having an aperture therethrough and at least one deflectable finger that extends at least partially into the aperture from an inner surface defining the aperture; and a bushing loaded into the aperture, the bushing including a stem extending along a bushing axis between a first flange and a second flange, the bushing defining a channel therethrough along the bushing axis; wherein the diameter of the aperture of the mounting ear is greater than the diameter of an outer surface of the stem such that an axially extending gap is formed between the inner surface of the mounting ear and the outer surface of the stem, the housing being floatable radially within the gap relative to the bushing.

2. The floatable connector of claim 1, wherein the first flange of the bushing deflects the at least one deflectable finger radially outward until the first flange moves beyond the at least one deflectable finger as the bushing is loaded into the aperture of the mounting ear.

3. The floatable connector of claim 1, wherein the stem of the bushing defines a groove that extends along a perimeter of the outer surface proximate to the first flange, the groove aligned with the at least one deflectable finger of the mounting ear.

4. The floatable connector of claim 1, wherein a distal end of the at least one deflectable finger engages an inner surface of the first flange to retain the mounting ear of the housing between the first and second flanges of the bushing.

5. The floatable connector of claim 4, wherein a first end of the mounting ear that is opposite to the distal end of the at least one deflectable finger engages an inner surface of the second flange to retain the mounting ear of the housing between the first and second flanges of the bushing.

6. The floatable connector of claim 1, wherein the bushing is configured to receive a fastener through the channel, the fastener configured to mount the floatable connector, the housing being floatable radially relative to the fastener.

7. The floatable connector of claim 1, wherein the housing has a mating end that extends through a window of a panel, the panel being fixed relative to the bushing, the housing being floatable relative to the panel to align with the window.

8. The floatable connector of claim 7, further comprising a compression seal disposed around a perimeter of the housing, the compression seal configured to be received between the housing and the window to seal the housing to the panel.

9. The floatable connector of claim 1, wherein the diameter of the second flange is greater than the diameter of the first flange.

10. The floatable connector of claim 1, wherein the housing includes a plurality of mounting ears, each mounting ear including a corresponding bushing therein.

11. The floatable connector of claim 1, wherein the mounting ear includes a plurality of deflectable fingers evenly dispersed around a perimeter of the inner surface and independently deflectable.

12. The floatable connector of claim 1, wherein the gap between the inner surface of the mounting ear and the outer surface of the stem is maintained along the length of the stem between the first and second flanges.

13. A floatable connector comprising:

a housing having a mating end and a mounting end, the mating end extending through a window of a panel, the housing having at least one mounting ear proximate to the mounting end, the mounting ear including an aperture therethrough and at least one deflectable finger extending at least partially into the aperture from an inner surface defining the aperture;

a compression seal disposed around a perimeter of the housing, the compression seal received between the housing and the window to seal the housing to the panel; and a bushing loaded into the aperture, the bushing including a stem extending along a bushing axis between a first flange and a second flange, the bushing defining a channel therethrough along the bushing axis, the bushing configured to receive a fastener through the channel, the fastener being fixed relative to the panel;

wherein the diameter of the aperture of the mounting ear is greater than the diameter of an outer surface of the stem such that an axially extending gap is formed between the inner surface of the mounting ear and the outer surface of the stem, the housing being floatable radially within the gap relative to the fastener and the panel to align with the window.

14. The floatable connector of claim 13, wherein the first flange of the bushing deflects the at least one deflectable finger radially outward until the first flange moves beyond the at least one deflectable finger as the bushing is loaded into the aperture of the mounting ear.

15. The floatable connector of claim 13, wherein the stem of the bushing defines a groove that extends along a perimeter of the outer surface proximate to the first flange, the groove aligned with the at least one deflectable finger of the mounting ear.

16. The floatable connector of claim 13, wherein a distal end of the at least one deflectable finger engages an inner surface of the first flange to retain the mounting ear of the housing between the first and second flanges of the bushing.

17. The floatable connector of claim 16, wherein a first end of the mounting ear that is opposite to the distal end of the at least one deflectable finger engages an inner surface of the second flange to retain the mounting ear of the housing between the first and second flanges of the bushing.

18. The floatable connector of claim 13, wherein the mounting ear includes a plurality of deflectable fingers evenly dispersed around a perimeter of the inner surface and independently deflectable.

19. The floatable connector of claim 13, wherein the fastener is coupled to a header and the panel is separately coupled to the header such that both the fastener and the panel are independently fixed relative to the header.

20. The floatable connector of claim 13, wherein the gap between the inner surface of the mounting ear and the outer surface of the stem is maintained along the length of the stem between the first and second flanges.

* * * * *